US008701688B2

(12) United States Patent
Vaughn et al.

(10) Patent No.: US 8,701,688 B2
(45) Date of Patent: Apr. 22, 2014

(54) VENT FOR A TENT OR SHELTER

(76) Inventors: Nicholas W. Vaughn, Derby, KS (US); Mitchell L. Wilgus, Andover, KS (US); Yiyun Culp, Wichita, KS (US); John Z. Rose, Wichita, KS (US)

( * ) Notice: Subject to any disclaimer, the term of this patent is extended or adjusted under 35 U.S.C. 154(b) by 0 days.

(21) Appl. No.: 13/387,695

(22) PCT Filed: Jul. 29, 2010

(86) PCT No.: PCT/US2010/043762

§ 371 (c)(1),
(2), (4) Date: Jan. 27, 2012

(87) PCT Pub. No.: WO2011/014689

PCT Pub. Date: Feb. 3, 2011

(65) Prior Publication Data

US 2012/0125389 A1 May 24, 2012

Related U.S. Application Data

(60) Provisional application No. 61/229,656, filed on Jul. 29, 2009.

(51) Int. Cl.
*E04H 15/16* (2006.01)

(52) U.S. Cl.
USPC ..... 135/94

(58) Field of Classification Search
USPC ..... 135/115, 91, 93, 94
See application file for complete search history.

(56) References Cited

U.S. PATENT DOCUMENTS

| | | | | | |
|---|---|---|---|---|---|
| 590,706 | A | * | 9/1897 | Lentz et al. | 160/54 |
| 1,531,622 | A | * | 3/1925 | Parsons | 135/93 |
| 2,230,454 | A | | 2/1941 | Freisner et al. | |
| 3,043,320 | A | * | 7/1962 | Moss | 135/93 |
| 3,356,098 | A | | 12/1967 | Krutzikowsky | |
| 3,388,712 | A | * | 6/1968 | Taylor | 135/98 |
| 3,670,747 | A | * | 6/1972 | Pohl et al. | 135/94 |
| 3,896,830 | A | | 7/1975 | Sharick | |
| 3,943,952 | A | * | 3/1976 | Marquart et al. | 135/93 |
| 4,265,261 | A | * | 5/1981 | Barker | 135/100 |
| 4,285,355 | A | * | 8/1981 | Lundblade | 135/147 |
| 4,709,718 | A | * | 12/1987 | Nichols | 135/125 |
| 4,796,649 | A | | 1/1989 | Tolomay | |
| 5,365,961 | A | | 11/1994 | Bamber et al. | |
| 5,396,917 | A | | 3/1995 | Hazinski et al. | |
| 6,021,796 | A | * | 2/2000 | Vavra | 135/147 |
| 6,151,841 | A | | 11/2000 | Green | |

(Continued)

FOREIGN PATENT DOCUMENTS

| | | | |
|---|---|---|---|
| JP | 07139228 | A | 5/1995 |
| JP | 09221941 | A | 8/1997 |

(Continued)

OTHER PUBLICATIONS

International Search Report PCT/US2010/043762 Apr. 27, 2011.

*Primary Examiner* — Noah Chandler Hawk

(57) ABSTRACT

A vent is provided for a tent or shelter. The vent is supported by a centrally located vent pole, the vent pole running lengthwise with the vent flap. The vent pole is formed of a construction that is resilient enough to support the vent during use, but is flexible enough so that the vent may be collapsed during storage.

9 Claims, 4 Drawing Sheets

(56) References Cited

U.S. PATENT DOCUMENTS

| | | | | |
|---|---|---|---|---|
| 6,286,531 | B1 | 9/2001 | Joo-Tai | |
| 6,318,294 | B1 | 11/2001 | Richmond et al. | |
| 6,499,497 | B1 | 12/2002 | Swetish et al. | |
| 6,662,816 | B1 | 12/2003 | Cunningham | |
| 7,401,618 | B2 | 7/2008 | Caldwell | |
| 8,590,554 | B2 * | 11/2013 | Choi et al. | 135/135 |
| 2005/0120640 | A1 | 6/2005 | Cantwell | |
| 2006/0021643 | A1 | 2/2006 | Brensinger | |

FOREIGN PATENT DOCUMENTS

| | | | |
|---|---|---|---|
| KR | 200246490 | Y1 | 10/2001 |
| KR | 200300920 | Y1 | 1/2003 |
| KR | 200319112 | Y1 | 7/2003 |

* cited by examiner

VENT FOR A TENT OR SHELTER

CROSS-REFERENCE TO THE REALTED APPLICATIONS

The present application is a U.S. National Phase Application under 35 U.S.C. §371 of International Application No. PCT/US2010/043762, filed on Jul. 29,2010, which claims priority to U.S. Provisional Patent Application No. 61/229,656, filed Jul. 29, 2009, the benefit of the filing date of which is hereby claimed under 35 U.S.C. §119 (e) and each of which are incorporated herein their entirety by reference.

FIELD OF THE INVENTION

The present invention is directed to tents and shelters, and more specifically vent for use with a tent or shelter.

BACKGROUND OF THE INVENTION

Camping is a popular recreational activity enjoyed by many. Some people camp so that they may enjoy the outdoors, and others use camping as an inexpensive alternative to staying in a hotel.

Typically, campers sleep in a tent while camping. Tents are portable shelters made of lightweight, often waterproof, fabrics. Typically, a tent is a collapsible shelter of canvas or other material stretched over and sustained by a frame. Tents are used for camping outdoors or as temporary structures, and come in a variety of shapes and sizes. The most popular shape is the dome, or free standing, model. This model is easy to set up and does not require support from tree limbs or other objects—when the tent is set up, the entirety of the pole structure for the tent is attached to the tent. This feature permits the erected tent to be lifted by one or more campers, without the tent losing its shape. A rain fly may extend over the pole structure of the tent, and may be attached to the tent or may be staked to the ground. The campers may also stake the tent to the ground.

For many free standing tent structures, long poles are used that are flexible and that are extended between opposite corners of the tent. These poles are bent into arcs so that the ends can be attached to the tent corners or elsewhere along the outside edges of the floor of the tent. The fabric of the tent is attached along the arcs, such as by loops, hooks, or sleeves. The ends of the poles that are attached to the corners of the tent (or alternatively at the edges of the floor of the tent), coupled with the attachment of the walls and the roof of the tent to the central portion of the poles puts the tent fabric in tension, causing the tent fabric to take structure. After all of the poles are put in place, the tent fabric is tensioned to form the free standing tent structure.

Because a tent is often a closed structure, the air within the tent becomes stale. Condensation, stale air, and other odors are often expelled by providing tent ventilation. This ventilation can be provided, for example by keeping the doors slightly open or by having windows in the tent. More recently, tents have been designed so they have a mesh top and a rain fly that extends over the tent and is spaced from the mesh top by the pole structure for the tent. In theory, the air flows out of the tent through the mesh material at the top of the tent and into the area between the rain fly and the tent. This air then circulates out from under the rain fly.

Although the mesh and rain fly construction of tents works well, the rain fly does not always provide optimal ventilation. Often, the rain fly extends almost to the ground and if a breeze is not directed properly between the tent and the rain fly, the air and condensation may still accumulate underneath the rain fly and proper ventilation may not be supplied.

Another structure that is often used while camping is a shelter. In general, a shelter is a structure, typically a frame with poles, that includes a covering or canopy that provides protection from the rain, insects, and/or the sun. For camping, a shelter is typically made of fabric and foldable poles so that the shelter may be folded into a compact configuration for transport and storage. The shelter may or may not have walls, such as screen walls. The shelter may be, for example, set up over a picnic area, used adjacent to a tent as a storage area, configured to serve as protection from the rain, or used as a screened area to avoid insects.

Shelters also need ventilation. In general, shelters have an apex and two or more sides that extend down from the apex and that are attached to poles or another support. Condensation and stale air can accumulate under this apex. In addition, in warmer weather, the environment under an unvented shelter can become rather warm.

SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

In accordance with one embodiment, a vent is provided for a tent. A vent pole is connected to the rain fly and is formed of a construction that is resilient enough to support a vent flap in an open position during use, but is easily removable and collapsible for storage.

In accordance with one embodiment, the vent pole comprises a fiberglass ridge pole spanning the distance between the vent flap edges along a center line of the rain fly.

In accordance with another embodiment, vent pole comprises a fiberglass ridge pole spanning the distance between the vent flap edge and the rain fly center point.

In accordance with another embodiment, a vent is provided for a shelter. A vent pole is connected to the body of the shelter and is formed of a construction that is resilient enough to support a vent flap in an open position during use, but is easily removable and collapsible for storage.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

Figure 1:
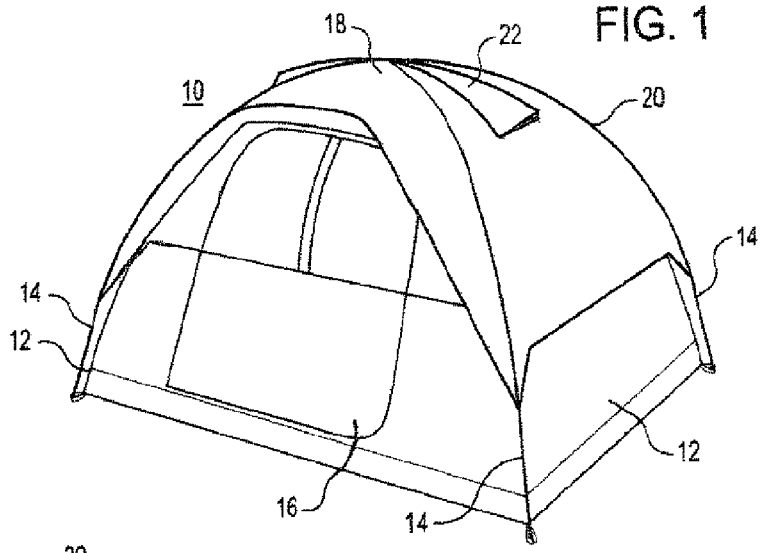
FIG. 1 is a front perspective view of a tent having a rain fly incorporating an embodiment of the present invention and comprising two vents.
Figure 2:
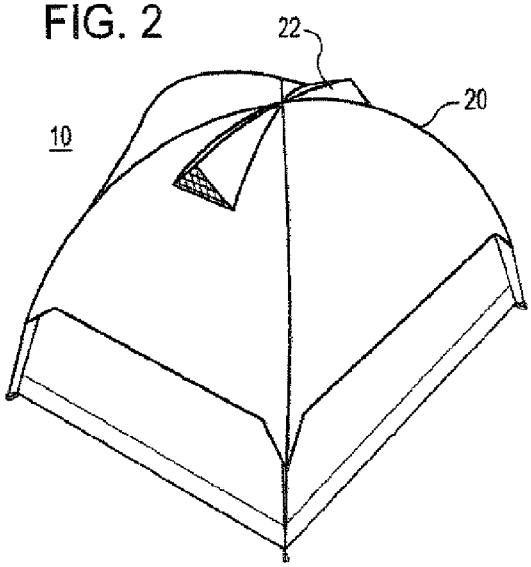
FIG. 2 is a rear perspective view of the tent of FIG. 1.
Figure 3:
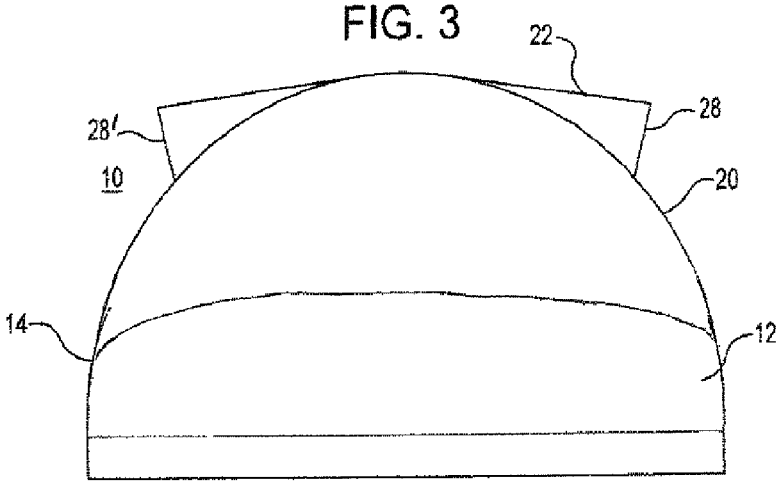
FIG. 3 is a schematic view of the rear of the tent of FIG. 1.
Figure 4:
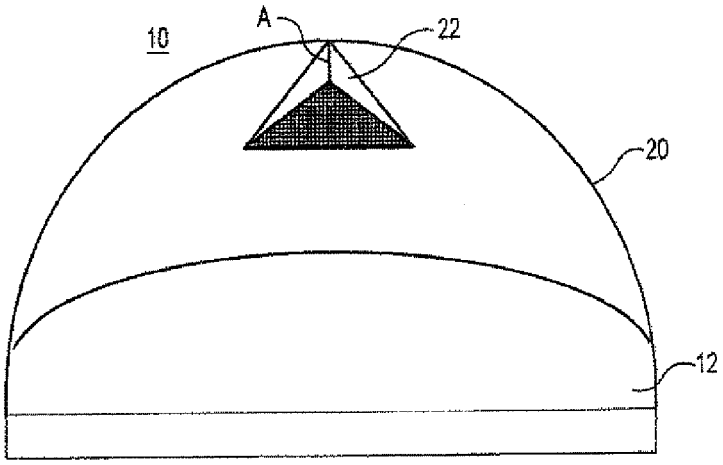
FIG. 4 is a schematic view of the side of the tent of FIG. 1.
Figure 5:
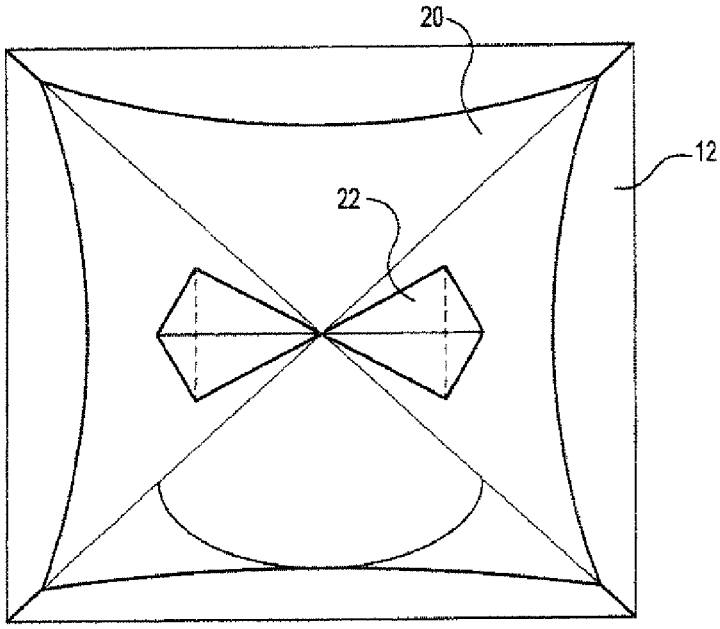
FIG. 5 is a schematic view of the top of the tent of FIG. 1.
Figure 6:
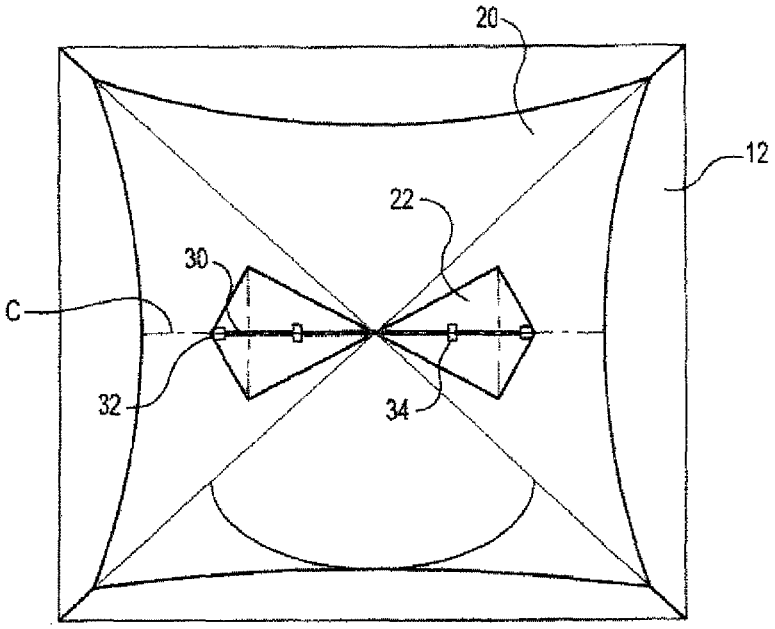
FIG. 6 is a schematic view of the underside of the rain fly of FIG. 1.

Referring now to the drawing figures in which like reference designators refer to like elements, there is shown in FIG. 1 a tent 10 incorporating an embodiment of the invention. The tent 10 shown in the drawings is a simplified model, and some poles and specific details for the tent 10 are not shown. However, the general configuration and manufacture of tents is known, and thus a specific configuration is omitted or simplified in order to not obscure the embodiments of the invention being described.

The tent 10 shown in the drawings is a free standing model. The tent 10 may also be considered a "dome" style tent, although features of the invention may be used in different models of tents, whether free standing, dome, or not. Thus, although described with reference to the tent 10, the invention may be utilized with many different types of tent structures. The tent 10 includes walls 12 and pole structure 14 for supporting the walls and the tent in a manner known in the art.

The tent 10 generally includes pole structure 14 for supporting the tent 10 in an upright, assembled configuration. Certain of the poles extend between opposite diagonal corners through sleeves (not shown) that extend along edges of sidewalls for the tent. In accordance with a manner known in the art, these poles are typically straight. When the poles are installed, they are extended through the sleeves and are bent into arcs and are attached at the corners of the tent 10. The tension in the poles places upward tension on the sleeves and outward tension on the corners. The sleeves cause the tension in the poles to drive the ends of the poles into to the corners, forcing the corners downward. The combined tension puts the tent walls and the tent floor in tension, which is counteracted by the inflexible nature of the tent walls. That is, the walls of the tent 10 are forced outward into the assembled position shown in FIGS. 1-5. In addition, the tension in the poles presses the corners outward, causes the floor of the tent 10 to be placed under slight tension, removing wrinkles and maximizing floor space within the tent 10. Thus, the connection of the poles provides stability for the tent 10 when the tent 10 is assembled. The poles connect directly to the tent, and the tent may be lifted while maintaining the structure shown in the drawing. To this end, the tent is "free standing," in that it does not need to be attached to the ground or another structure for stability. However, embodiments of the present invention can be used with tents having a different structure.

Figure 8:
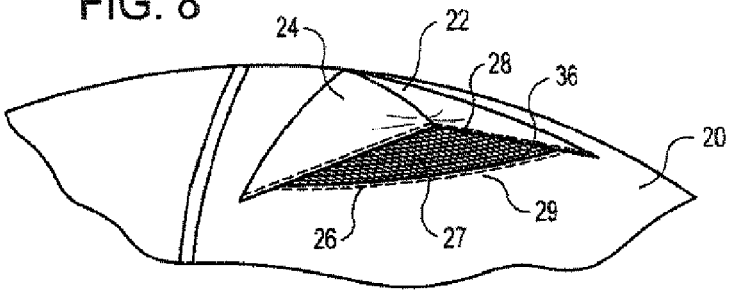
FIG. 8 is a detailed view of a top portion of the tent of FIG. 1.

The tent 1 includes a rain fly 20 covering a top portion of the tent 10. The rain fly 20 is supported across the top of the pole structure 14, and may additionally be attached to the ground by stakes (not shown, but known in the art). The rain fly 20 may also be secured over the tent by poles, guy lines, clips or other connectors (not shown, but known in the art). As shown in FIGS. 1-4, the tent 10 includes a door 16 and preferably includes windows (not shown). The door and windows are preferably selectively closable as is known in the art. The tent 10 may also include an awning 18 extending out a front side of the tent 10 as shown in FIG. 1. The awning, however, is optional. Similarly, the tent 10 may have a vestibule extending from any or all sides of the tent 10 and may also have additional awnings so extending from more than one side of the tent 10. Specifics of the tent design such as the size, shape, location and number of doors, windows or other openings, awnings, vestibules and other features common in tents are not essential to the invention and various configurations known in the art may be used.

in accordance with one embodiment, as depicted in FIGS. 1-5, a vent 22 is positioned at a top portion of the rain fly 20 for the tent 10. As shown in FIG. 8, the vent 22 includes an upper flap 24 that is separate from a main body of the rain fly 20. The upper flap 24 includes an outer edge 28. The vent 22 also includes an inner flap 26, typically made of the main structure of the rain fly 20. The inner flap 26 includes an inner edge 29. If desired, as shown in FIG. 8, the inner flap 26 may be attached to a mesh portion 27 of the rain fly 20 covering opening 36. The mesh portion 27 extends under the upper flap 24, and may serve to prevent insects from entering the vent 22, and may aid in maintaining the shape of the rain fly 20. Alternatively, rain fly 20 may be open (i.e., no mesh or other material) under the upper flap 24. Preferably, in either configuration, the inner flap 26 extends beneath the upper flap 24 a sufficient amount so that rain is prevented from falling through the vent 22 and onto the tent 10. It would also be within the scope of the present invention, however, for the mesh portion 27 or open portion to extend past the outer edge 28.

Figure 9:
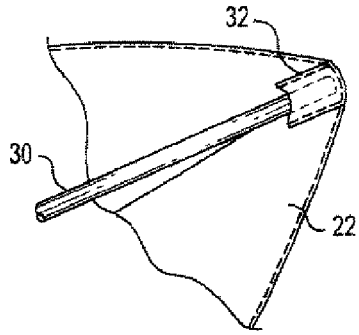
FIG. 9 is a detailed view of the pocket of the tent of FIG. 1, with a vent pole retained therein.

In accordance with an embodiment of the invention, a vent pole 30 is provided for maintaining the vent 22 in an open position to allow for maximum ventilation. Vent pole 30 preferably runs lengthwise along center of vent 22 on the underside, forming an apex A on the top of vent 22. Vent pole 32 is preferably in a generally perpendicular orientation to opening 36, although other orientations are within the scope of the present invention. The vent pole 30 extends across a central point P in the rain fly along a center line C, spanning from the outer edge 28 of a first vent 22*a* on one side of the tent 10 to the outer edge 28' of a second vent 22*b* located on the opposite side of the tent 10, as shown in FIGS. 1-6. As shown in FIGS. 1-6, a single vent pole 30 supports two separate vents 22 in the open position through use of tension. Upper flap 24 comprises a pocket 32 located on the underside of the fabric at outer edge 28. As shown in FIG. 9, pocket 32 is configured to retain and secure end 31 of vent pole. Vent pole 30 is preferably the same length or slightly longer than the distance between the outer edge 28 of first vent 22*a* on one side of the tent 10 and the outer edge 28' of a second vent 22*b* located on the opposite side of the tent 10 so that when the ends 31, 31' of the vent pole are inserted into the pockets 32, 32', the pole 30 becomes tensioned and pulls the fabric of the vents 22, 22' taut thereby creating a ridge or crease as shown in FIGS. 1-4 and keeping the vent 22, 22' in the open position to allow for ventilation underneath.

Vent upper flap 24 is generally triangular in shape as this shape forms a good apex A and assists is drainage and water runoff, but other shapes such as semi-circular, trapezoidal, square and the like are within the scope of the present invention. Vent 22 is preferably made of the same fabric as the tent 10 or the rain fly 20, but may also be made of fabric having a different color or a fabric having similar characteristics thereto. Upper flap 24 is connected to the top of the rain fly 20 along the side edges 24*a*, 24*b* and remains open at outer edge 28. A small opening remains at the inner-most point A of upper flap 24—as shown in FIGS. 1-5 this point is located at the point where the side edges 24*a*, 24*b* meet—to allow for passage of vent pole 30 therethrough and under upper flap 24. Upper flap 24 is preferably stitched to rain fly 20, however, other means for securing fabric to fabric which are known in the industry are also within the scope of the present invention, such as the use of an adhesive, fabric welding and the like.

Pocket 32 serves to retain and secure end 31 of vent pole 32 to vent 22 such that the fabric is held tautly between the two vents 22, 22'. Other means for retaining the vent pole end 31 are within the scope of the present invention including retaining the pole end 31 in a seam located along outer edge 28 end of vent pole or other pole retention means known in the art. Additional retaining means 34 may be used to secure vent poles 32 to rain fly 20 at various points along the center line C. Preferably, hook and loop fasteners are attached to the underside of rain fly 20 along center line C and secure vent pole 32 by wrapping around the pole or otherwise encircling the pole to retain the pole 32 in the general location and orientation. It is also within the scope of the present invention to utilize other additional retaining means such a fabric ties, fabric loops, elastic loops, elastic strips or other conventional fastening means known in the art, including a sleeve (not shown) located on either the top side or underside of rain fly 22.

Pocket 32 is preferably made of fabric and more preferably is made of a mesh fabric. Other fabrics are also within the scope of the invention, however, and pocket 32 may be made of the same fabric as the tent 10 or the rain fly 20 or a fabric having similar characteristics thereto. Pocket 32 may also be made of webbing or other flexible material. Pocket 32 is secured to the underside of upper flap 24 at outer edge 28 along three sides, leaving the inner-most fourth side open so as to receive the end 31 of vent pole 30. Pocket 32 is preferably secured to upper flap 24 by stitching, but may also be secured by other means known in the industry such as the use of an appropriate adhesive, fabric welding and the like. Pocket 32 is preferably square or trapezoidal in shape so as to adequately retain end 31 of pole 30. Other shapes, however, such as triangular, semi-circular and the like are within the scope of the present invention as long as adequate retention for the pole end 31 is provided. In such case, the sides of the pocket 32 are appropriately secured to the upper flap 24.

In accordance with an embodiment of the invention, the vent pole 30 is a flexible, resilient structure. The vent pole 30 is flexible in that it is capable of being bent or collapsed so that the vent 20 may be folded for storage. Pole 32 is preferably formed of a single piece of material, but may comprise multiple sections which fit together in a telescoping manner as is known in the art, or may utilize other flexible conventional tent poles known in the art. In use, the user would assemble and erect the tent according to specific instructions for the particular style of tent. The vent poles 32 are inserted into the vents 22, the ends 31 of the poles are secured within pockets 32, and additional retaining means 34 are appropriately secured. The rain fly 20 is then secured over the top of the tent 10. In addition to assisting with ventilation, the tautness of the fabric and the ridge created by the vent pole 32 provides good drainage and water displacement in rainy conditions. The vent pole 32 is located inside the fly and creates the apex A or "crease" shown in FIGS. 1-5.

Figure 7:
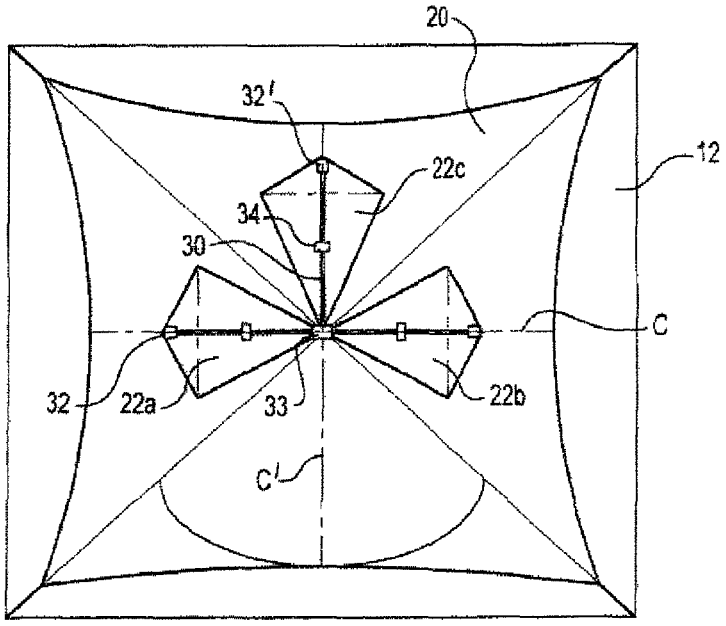
FIG. 7 is a schematic view of the underside of the rain fly of an alternative embodiment comprising a single vent.

In accordance with an embodiment, as shown in FIGS. 1-6, rain fly 20 comprises between one and three vents 22 and preferably comprises two vents 22*a*, 22*b* located on opposite sides of the tent 10. If three vents 22*a*, 22*b*, 22*c* are desired, as shown in FIG. 7, the third vent 22*c* is preferably located on the back side of the tent 10. Vent pole 32 would support the first and second vents 22, 22' as described above. Additional vent pole 32' would support third vent 22*c*. As the distance to span is shorter because there is only one vent along the center line C', vent pole 32' is approximately half the length of vent pole 32 and is sized appropriately so as to maintain the tautness of the third vent 22*c*. Center line C and center line C' are preferably in an approximate perpendicular orientation, but other angles and orientations may be used. Center pocket 33 is provided near center point P and is constructed in a manner similar to pocket 32 described above. Vent pole 32' spans the distance between center pocket 33 and pocket 32 as shown in FIG. 7. This particular construction is applicable for a rain fly having an odd number of vents.

In yet another embodiment, center pocket 33 may be used for receiving and retaining the inner most ends 31 of all vent pole 32 such that all vent poles 32 are shorter in length and span only the distance from the center point P of tent 10 to the outer edge 28 of vent 22. In such case, center pocket 33 is configured appropriately to accommodate the desired number of vent poles and center pocket 33 comprises the appropriate number of actual pockets to so receive each pole end 31.

In another embodiment, rain fly 20 may comprises any number of vents over three and may have a vent located on each side of the tent 10. It is also within the scope of the present invention to have more than one vent per side.

Vent 22 may be located at any distance from center point P along center line C. It is also within the scope of the present invention for vent 22 to be offset from center line C, using an appropriate vent pole and vent flap structure.

Figure 10:
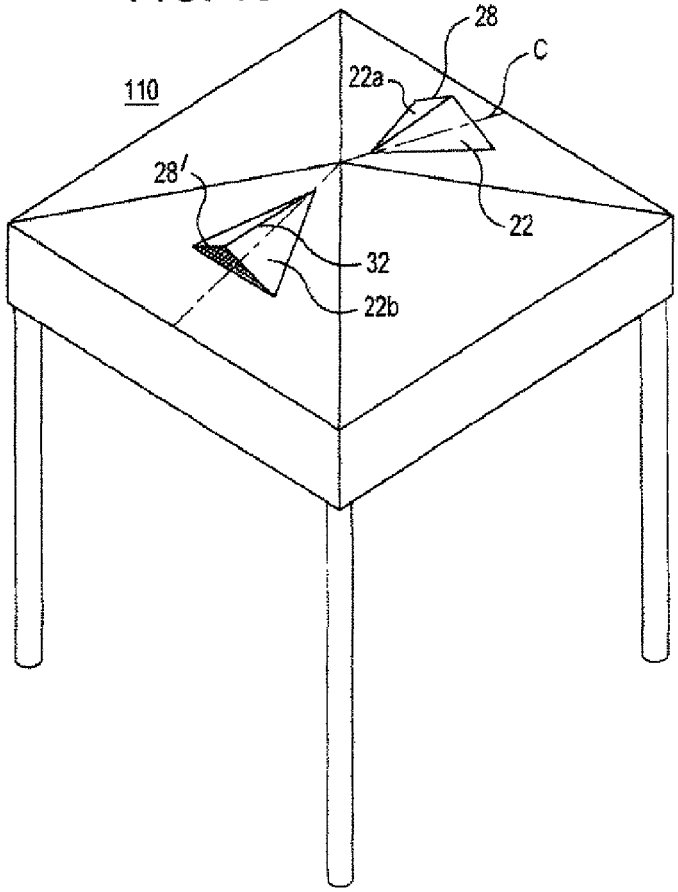
FIG. 10 is a perspective view of a shelter incorporating an embodiment of the present invention.

In an embodiment shown in FIG. 10, vent 22 is located on a shelter 110. Shelter 110 preferably has four sides 112*a-d* as known in the art, and may or may not have sidewalls extending the entire distance to the ground (FIG. 10 depicts a shelter not having full side walls). It is also within the scope of the present invention for shelter 110 to have more or less than four sides. As with conventional shelters, shelter 110 has a top 113. Depending on the length of the sidewalls (not shown), shelter 110 may or may not have openings such as a door and windows. Shelter 110 is supported by frame 114 as is known in the art and specific details are not included so as not to obscure the embodiments of the invention being described. As is known in the art, shelter 110 may in addition be supported by stakes, guy lines and the like. As described above with respect to the tent 10, vent pole 30 extends across a central point P in the shelter top along a center line C, spanning from the outer edge 28 of a first vent 22*a* on one side of the shelter 110 to the outer edge 28' of a second vent 22*b* located on the opposite side of the shelter 110. It is within the scope of the present invention for shelter 110 to have any number of vents 22 ranging from one for the entire shelter to one for each side of the shelter or even more than one vent 22 per side of the shelter 110. The construction of the vent 22, vent pole 30, pocket 32 and other elements are as described above with respect to the tent 10.

All references cited herein are expressly incorporated by reference in their entirety.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A tent, comprising:

a tent frame;

a fabric structure defining an enclosure and having a closed top formed at least partially of material that allows airflow therethrough, at least one of the top of the fabric structure or one or more side walls of the fabric structure supported by the frame;

a removable rain fly having a perimeter edge, said removable rain fly covering and spaced apart from at least a part of the top of the fabric structure when the rain fly is in place, said removable rain fly comprising at least one vent located over the top of the fabric structure when the rain fly is in place and spaced apart from said perimeter edge and having a flap; and at least one extension member removably connected to said vent flap to support said flap and maintain said vent in an open position.

2. The tent of claim 1, wherein said extension member extends lengthwise along said vent flap and in a generally perpendicular orientation to an opening located at an outer edge of said vent flap.

3. The tent of claim 1, wherein the top of the fabric structure includes a mesh material located under the rain fly when the rain fly is in place.

4. A tent, comprising:

a tent frame;

at least one of a top or side wall supported by the frame;

a rain fly having a perimeter edge, said rain fly spaced apart from and covering at least a part of the top of said tent when the rain fly is in place, said rain fly comprising:

a first vent having a first flap through a top side of the rain fly, the first vent spaced apart from said perimeter edge and located over the top side of the tent on a first side of the rain fly when the rain fly is in place; and a second vent having a second flap through a top side of the rain fly, the second vent spaced apart from said perimeter edge and located over the top side of the tent on a second side of the rain fly opposite said first side when the rain fly is in place; and at least one extension member extending from an outer edge of the first flap to an outer edge of the second flap to support said flaps and maintain each of said vents in an open position.

5. The tent of claim 4, wherein the at least one extension member comprises at least a first extension member extending to the outer edge of the first flap and at least a second extension member extending to the outer edge of the second flap.

6. The tent of claim 5, wherein said at least one extension member extends downward from a central apex to at least one vent flap.

7. The tent of claim 4, wherein said at least one extension member is removably connected to at least one vent flap to support said flap and maintain said vent in an open position.

8. The tent of claim 4, wherein said at least one extension member extends through a central apex of the rain fly.

9. The tent of claim 4, wherein the top of the fabric structure includes a mesh material located under the rain fly when the rain fly is in place.

* * * * *